United States Patent [19]

Grevich

[11] 4,016,026

[45] Apr. 5, 1977

[54] SEGMENTED HEATER FOR BAND SEALERS

[75] Inventor: John J. Grevich, Star Prairie, Wis.

[73] Assignee: Domain Industries, Inc., New Richmond, Wis.

[22] Filed: Feb. 24, 1975

[21] Appl. No.: 552,714

[52] U.S. Cl. ..... 156/555; 93/DIG. 1; 100/93 RP; 100/151; 156/582; 156/583; 425/371

[51] Int. Cl.[2] ..... B30B 5/06; B30B 15/34

[58] Field of Search ..... 156/582, 555, 580, 583, 156/311; 425/371, 329; 100/151, 93 RP; 93/DIG. 1; 53/379

[56] References Cited

UNITED STATES PATENTS

| | | | |
|---|---|---|---|
| 2,137,505 | 11/1938 | Osgood | 156/580 |
| 2,542,901 | 2/1951 | Chaffee | 100/151 |
| 2,618,426 | 11/1952 | Stover | 100/153 |
| 2,658,552 | 11/1953 | Grevich | 100/151 |
| 3,547,742 | 12/1970 | Cottrell | 156/583 |
| 3,841,390 | 10/1974 | DiBenedetto et al. | 425/371 X |

*Primary Examiner*—Charles E. Van Horn
*Assistant Examiner*—M. G. Wityshyn
*Attorney, Agent, or Firm*—H. Dale Palmatier

[57] ABSTRACT

Heater bars for a film sealing machine with traveling bands which grip and transfer heat to the film laminae, the heater bars having heat transfer slides spring pressed and guided for tilting in a horizontal plane against the bands and tiltable to accommodate variations in film thickness between the bands to continuously apply heat to all adjacent portions of the films traveling with the bands.

11 Claims, 8 Drawing Figures

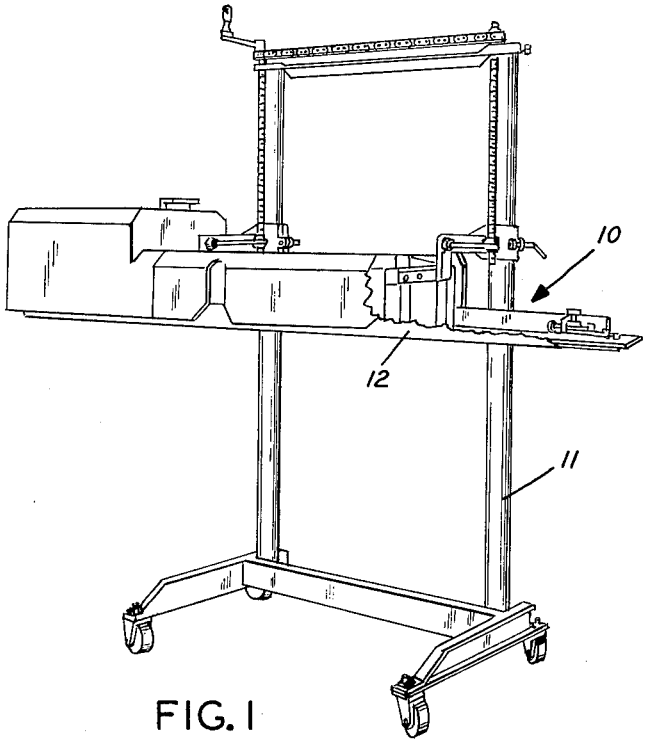
FIG. 1
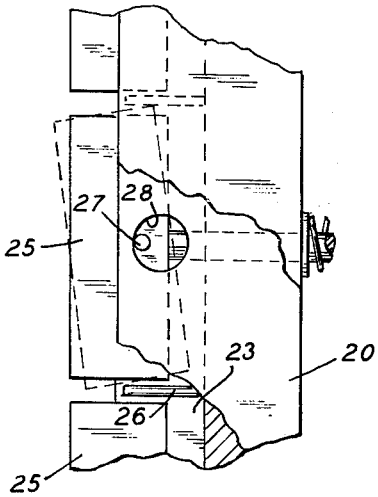
FIG. 7
FIG. 2
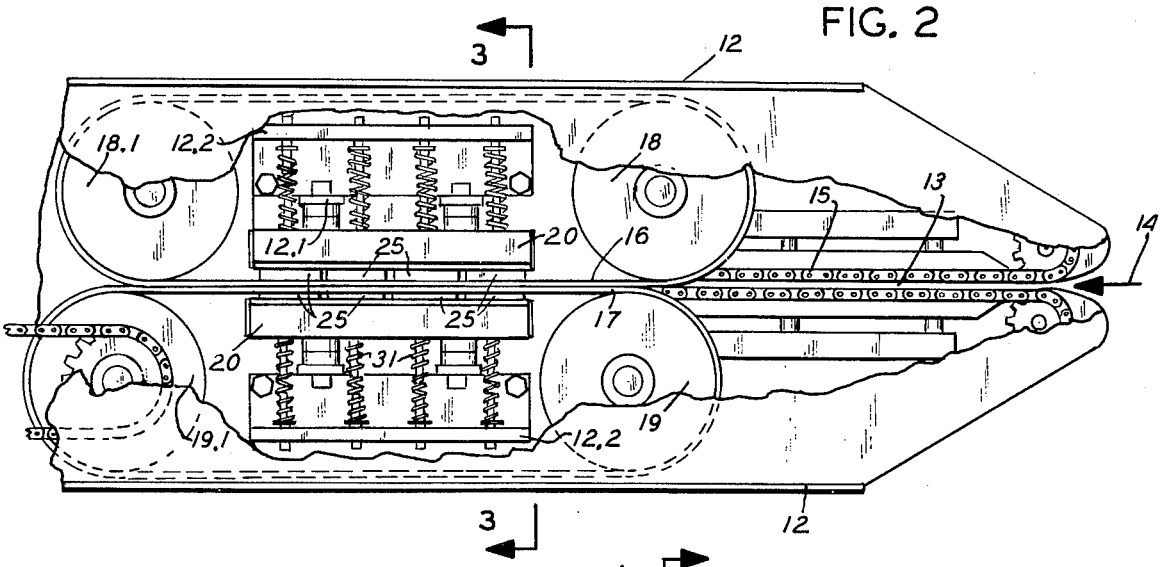
FIG. 3
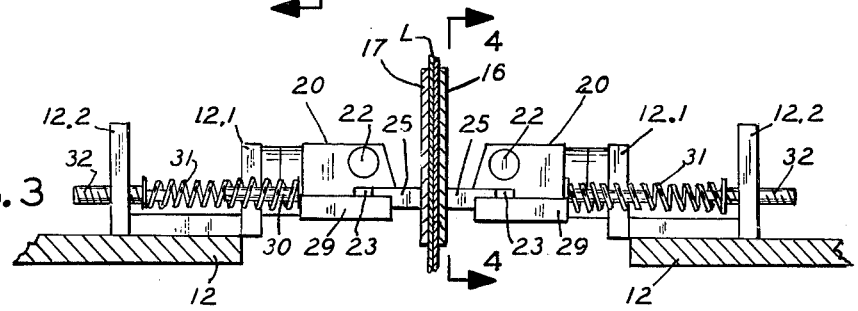

SEGMENTED HEATER FOR BAND SEALERS

BRIEF SUMMARY OF THE INVENTION

This invention relates to heater bars for sealing machines and, more particularly, relates to the heater bars for transferring heat from a heating element to a continuously traveling band which conveys films through the sealing machine to be sealed together, such as in sealing bags and other containers for merchandise.

A pair of continuous bands, made of steel or fiber glass or other similar materials, are arranged to travel in confronting relation with each other along a sealing run, and the bands hold the film laminae against each other, and under some pressure, and in this linear run of the bands, heat is applied through the bands from heater bars for sealing the film laminae together. Heat is supplied to the bands from heater bars which are mounted on the frame of the machine. Such heater bars for supplying heat to the bands have been mounted to be stationary with respect to the frame of the machine, and in such instances, the heater bars must be located so that they will be close to the traveling bands, but allowance must be made for the thickness of the film material as well as some additional spacing so that the film material will not produce jamming of the machine in the event that wrinkles or multiple thicknesses are encountered.

Otherwise the heater bars are in some instances mounted on springs so that the entire heater bar is movable inwardly and outwardly for applying pressure against the moving band and the film material being heat sealed so that the sealing is effected under compressive pressure and further, some allowance is made for the heater bars to separate from each other and allow the bands to separate from each other when wrinkled portions of the film laminae or multiple thicknesses of the film pass through the machine during sealing.

Regardless of the particular manner of mounting the bars in the past, there has been some difficulty in obtaining a desirable seal of the film material, particularly where there is any variance in the thickness of the film material as it passes through the machine. Unless the film is absolutley wrinkle-free, certain portions of the film, near the wrinkles, will not be sealed as well as they should be.

The present invention incorporates a stationary heater bar rigid with the frame of the machine and located adjacent the traveling bands which transfer sealing heat to the film material being heat sealed. The heater bars have a plurality of heat transfer elements, each being spring loaded to exert pressure against the band and film being heat sealed, and each of the heat transfer elements has a good deal of freedom of movement in a horizontal plane to move toward and away from the band and to orient itself at varying oblique angles with respect to the other heat transfer elements and the heater bar so as to heat all portions of the film moving through the machine uniformly and maintain uniform pressure on all portions of the film to obtain a uniform sealing. The individual heat transfer elements are readily and independently replaceable, and may be of varying materials such as copper, brass, carbon, etc., in order to obtain the transfer of heat in the desired temperature range. Also, depending upon the particular material from which the bands are made, the heat transfer elements may be made of a compatible material to avoid unnecessary wear while providing for efficient transfer of heat.

The spring loaded heat transfer elements continuously bear inwardly against the bands with a slight pressure derived from the springs. The heater bars are therefore considered to be self-adjusting, regardless of the thickness of material in the bag which passes with the bands between the bars.

BRIEF DESCRIPTION OF DRAWINGS

FIG. 1 is a perspective view of a sealing machine.

FIG. 2 is a top plan view, partly broken away, for clarity of detail showing the heater bars and heat transfer elements according to the present invention.

FIG. 3 is an enlarged detail section view taken approximately at 3—3 in FIG. 2.

FIG. 7 is an enlarged detail bottom plan view seen at 7—7 in FIG. 6 and with portions broken away for clarity of detail.

DETAILED DESCRIPTION OF THE INVENTION

Figure 4:
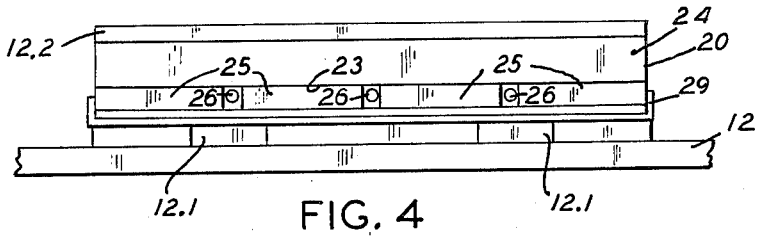
FIG. 4 is an enlarged detail elevation view taken approximately at 4—4 in FIG. 3.

One form of the invention is illustrated in the FIGS. 1 – 7. The sealing machine is indicated in general by numeral 10, and although this sealing apparatus is mounted on a transportable floor stand 11, the sealing machine could be supported in any of a number of ways. The sealing machine has a frame 12 defining a slot 13 extending throughout the entire length of the frame to receive and convey film laminae therethrough such as the tops of bags to be closed. The bags or film laminae will travel through the machine in the direction as indicated by arrow 14. Conveyor chains are carried on sprockets suitably journaled on the frame for gripping the bag below the top edge thereof and carrying the bag or film laminae through the machine. The upper edge portion of the bag or film laminae will pass between a pair of endless sealing heat transfer bands 16 and 17 which may be formed of steel with heat resistant slippery plastic coatings on the faces thereof to prevent sticking of the bands to the film laminae being sealed. The bands 16 and 17 may otherwise be formed of fiber glass or other suitable material which has the strength and temperature resisting characteristics to serve the purpose.

Band 16 is trained around a pair of guide wheels 18 and 18.1, and band 17 is trained around the guide and drive wheels 19, 19.1. It will be noted that the adjacent wheels 18 and 19 are not directly opposite each other, but are slightly offset, and similarly, the wheels 18.1 and 19.1 are not directly opposite each other but are also slightly offset with respect to each other. This offset relationship permits the peripheries of the wheels to bring the bands into closely spaced and substantially parallel relation with each other while allowing adequate spacing between the peripheries of the wheels as to permit several thicknesses of the film laminae, or films of varying thicknesses to be moved between the wheels. The wheels are driven from a suitable source of power and are coordinated in their motion with respect to each other as to move at the same speed as the chain 15 and at the same speed with respect to each other as to carry the film laminae past the heater bars 20 to obtain the necessary heating and sealing of the film laminae.

Identical heater bars 20 are disposed at opposite sides of the bands and confront the linear runs of the bands to effectively create a heating station. The heater bars 20 are preferably made of steel and are suitably mounted on appendages 12.1 of the frame 12 so as to be stationary with the frame. Each of the heater bars 20 has an elongate opening 21 extending longitudinally throughout the length thereof, and an electric heating element 22, or other source of heat extends through the opening 21 for applying heat to the heater bar for transfer to the film laminae. Each of the heater bars has an elongate slot 23 extending throughout the length of the bar and opening through the side face 24 of the bar which confronts the bands 16, 17.

Figure 5:
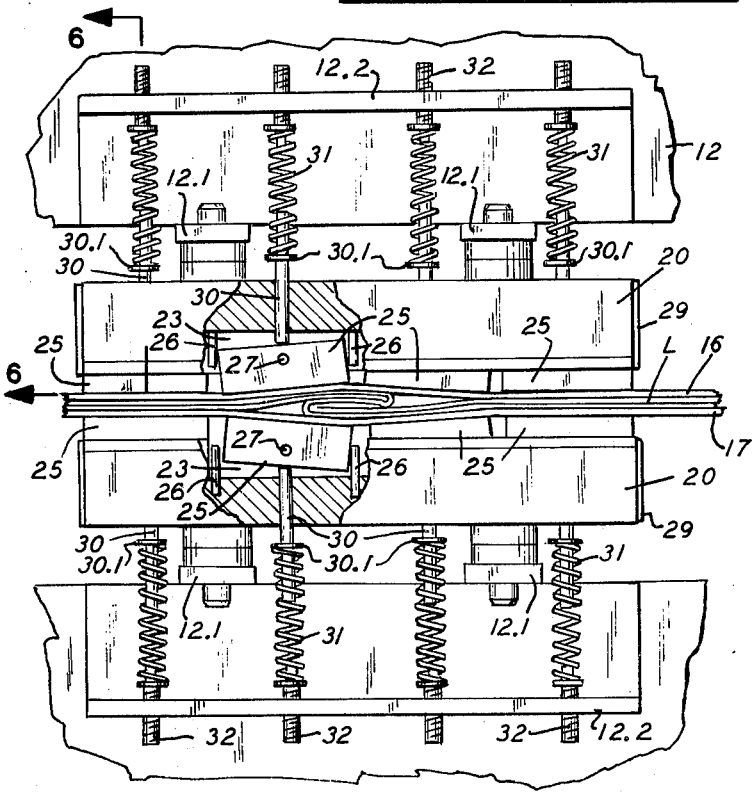
FIG. 5 is an enlarged detail top plan view of the heater bar assembly, with portions broken away and shown in section for clarity of detail.

A plurality of heat transfer slides 25 are mounted in the slots 23 in close fitting, but freely slidable and tiltable relation. The slides 25 are in the shape of rectangular blocks and may be formed of copper, brass, carbon and other readily heat conductible heat conducting materials of such a nature as to minimize wear as the bands 16 and 17 travel along the slides continuously. The slides 25 are spaced from each other in the slots 23, and the ends of the slides 25 are guided for inward and outward movement by pins 26, which protrude, within the slots, toward the bands 16 and 17. The slides 25, lie substantially horizontally, and the top and bottom faces of the slides lie substantially flush with the confronting sides of the slots 23 for rather efficient heat transfer. Each of the slides 25 has an aperture extending transversely therethrough and a readily removable retainer pin 27 in the aperture and protruding into one of the plurality of openings 28 formed in the adjacent heater bar 20. The pin 27 is free to move about in the opening 28 as the slide moves inwardly and outwardly transversely of the bands 17 and as the slide 25 tilts to various angles as illustrated in FIG. 5. However, the pins 27 prevent the slides 25 from dropping out of the heater bars 20. A coverplate 29 underlies the bar 20 and covers all of the openings 28 to retain the pins 27 in operative position. The coverplate 29 is retained on the heater bar 20 as by screws and may be readily removed for withdrawing the pins 27 which facilitates ready removal and replacement of the slides 25 as they wear or as different types of slides 25 may be desirable.

Each of the slides is continuously urged outwardly toward the adjacent sealing band 16, 17, by a slide rod 30 which protrudes rearwardly through a bearing aperture 33 in the heater bar 20. Each of the rods 30 protrudes into the end of a compression spring 31 and has a stop ring 30.1 affixed thereto to bear against the spring. The spring 31 allows rearward movement of the rod 30 and slide 25 away from the band, but continuously applies pressure against the slide 25 and through the band 16, 17, against the film laminae being sealed. The rear ends of springs 31 fit into adjustment screws 32 threaded into an appendage 12.2 of the frame so as to regulate the amount of pressure applied by the springs on the slides 25.

In operation, it will be seen that the chains 15 carry the film laminae or bags into the machine and then the upper edges of the film laminae are confined between and conveyed along with the bands 16 and 17 as illustrated in FIG. 3. The film laminae are denominated by the letter L. In the event that the thickness of the film laminae varies slightly from one location to another or as the edge of a bag is passing through the machine, the slides 25 will be free to move inwardly and outwardly relative to the film laminae to maintain the constant pressure on the film laminae, while accommodating any variances in thickness by being free to tilt as illustrated in FIG. 5. Accordingly, all portions to the film laminae receive substantially the same heat and pressure and will be sealed together to produce a secure joint or seal between the laminae for completely welding the laminae together.

The transfer elements 25 continuously bear against the bands 16 and 17 under influence of springs 31 so as to continuously exert a slight pressure on the bands 16 and 17 and accordingly exert pressure on the plastic laminae being sealed together. If the plastic material in various bags or laminae varies somewhat in thickness, or if a different thickness of material is selected, no adjustment of the mechanism is required because the apparatus is self-adjusting to accommodate to the various thicknesses of laminae.

Figure 6:
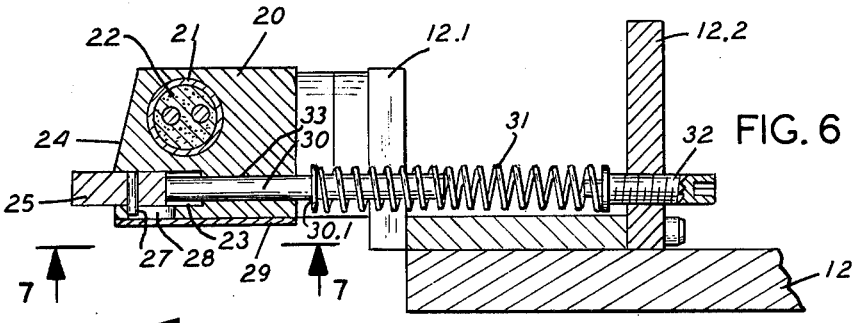
FIG. 6 is an enlarged detail section view taken at 6—6 in FIG. 5.
Figure 8:
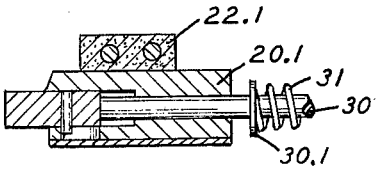
FIG. 8 is a detail section view of an alternative form of the heater bar assembly, employing a flat bar type of heater.

In FIG. 8, a modified form of the heater bar is illustrated and is indicated by the numeral 20.1. This heater bar has a flat heating element 22.1 applied to the top surface of the heater bar instead of through an opening as illustrated in FIG. 6. Other than the modified form of heater and accommodation for it, the heater bar 20 is substantially identical to that previously described.

What is claimed is:

1. A machine for sealing laminae of film together in closing bags and the like, comprising a frame;

a pair of flexible, endless sealing heat transfer bands confronting each other and traveling together to receive and carry the film laminae therebetween for sealing;

a pair of elongate heater bars on opposite sides of confronting portions of the bands and extending therealong, each of the bars having an elongate front face with a slot therein confronting a respective heat transfer band in spaced relation therewith;

a plurality of elongate heat transfer slides carried in the slot of each heater bar and extending along the adjacent band, each of the slides having a longitudinally extending bearing face continuously engaging and transferring sealing heat to the adjacent band, the slides and heater bars having a non-interfering relation along said slot whereby to permit freedom of movement of the slides in a direction toward and away from the flat side of the bands, and to also permit said slides to be freely obliquely tiltable in the slot about axes extending parallel to the flat sides of the bands in the linear run and also extending transversely of the direction of travel of the bands along the linear runs such that the slides may follow any non-linearity in the bands and to maintain complete face to face contact with the bands as short lengths of the bands variously orient at oblique angles as the film is carried along with the bands; and springs urging the slides toward the bands.

2. The invention set forth in claim 1 and the slides being in close fitting relation to the slot to be maintained substantially in the plane of the slot and with the side faces of the slides engaging the sides of the slot for transferring heat from the bar to the slides.

3. The invention according to claim 1 and each heater bar having an elongate opening extending longitudinally therethrough, and a heat generating element extending through said elongate opening and applying heat to the heater bar for transfer to the film laminae.

4. The invention according to claim 1 and each heater bar having a heat generating element lying at the exterior thereof and supplying heat to the heater bar for transfer to the film laminae.

5. The invention according to claim 1 and means interconnecting the springs with the slides and minimizing any restraint by the springs against the oblique tilting of the slides whereby the bearing face of each slide may fully engage the adjacent band without regard to the action of the springs.

6. The invention according to claim 5 and each of the slides having opposite ends and a back side opposite the bearing face, and such means interconnecting the springs with the slides including a plurality of spring-pressed slide rods each extending toward and spring-pressed toward a respective slide and toward the adjacent band, each rod engaging the back side of a respective slide intermediate the ends thereof whereby to minimize the restraint on the slide against such tilting while asserting significant restraint on the slide as a whole against movement away from the adjacent band.

7. A machine for sealing laminae of film together as in closing bags and the like, comprising a frame;

a pair of endless, sealing, heat transfer bands confronting each other to receive and carry the film laminae therebetween for sealing;

a pair of elongate heater bars supplying heat and extending along the bands for effecting the seal of the film between the bands, each of the heater bars being mounted on the frame and each of the heater bars having one face confronting one of the endless bands, each of the heater bars having an elongate slot opening through the face thereof, the elongate slot extending substantially throughout the length of such heater bars;

a pair of heaters each applying sealing heat to the respective heater bar;

a plurality of heat transfer slides in the slot of each heater bar and movable transversely of the elongate heater bar and in a direction toward and away from the adjacent heat transfer band, each of said slides being in continuous contact with the band as the band moves with the film and moves toward and away from the heater bar;

springs urging the slides toward the bands and maintaining pressure on the bands and the film laminae carried by and being sealed between the bands, each of the heater bars having a plurality of openings each disposed adjacent a respective slide and communicating with the slot; and a plurality of pins each carried on a respective slide and extending into the adjacent opening of the heater bar to retain the slide in the slot of the heater bar.

8. The invention according to claim 7, and said pins being readily removable from the slides, and a coverplate overlying all of said openings and bearing against the ends of the pins to retain the pins in the slides.

9. In a film sealing machine having a frame and having a pair of flexible, endless, sealing, heat transfer bands adjacent each other and having linear runs with substantially flat inner sides confronting each other to receive and carry the film laminae therebetween for sealing, said linear runs of the bands normally engaging each other and being separable to receive film laminae therebetween, the linear runs of the bands also having flat outer sides, means mounting said bands on the frame for movement along said runs, heating means on the frame and extending along said linear runs of the transfer bands and supplying sealing heat to and through the bands to the film laminae between said runs, said heater means including non-rotating heat transfer elements with flat surfaces continuously bearing inwardly and sliding against the flat outer sides of said linear runs of both of the heat transfer bands, said heating means including elongate heated bars stationary on the frame and extending along the runs, each bar carrying a plurality of said heat transfer elements and permitting movement of said elements in a direction toward and away from the linear runs of said bands, the bars of the heating means permitting tilting of the heat transfer elements obliquely of the linear runs and about axes extending generally parallel to such flat outer sides and also extending transversely of the direction of travel of the bands along such linear runs of the bands to permit occasional multiple thicknesses of film material to pass along said linear runs while maintaining efficient heating of the adjacent areas of the film laminae, and spring means urging said heat transfer elements toward the linear runs of said heat transfer bands, said spring means being yieldable under influence of film laminae passing between the bands which bear outwardly against the heat transfer elements and allow separation of the bands to allow the film laminae being sealed to pass along the linear runs while continuously maintaining spring pressure against the film laminae during the heating and sealing.

10. In a film sealing machine having a frame and having a pair of flexible, endless, sealing, heat transfer bands adjacent each other and having linear runs with substantially flat inner sides confronting each other to receive and carry the film laminae therebetween for sealing, said linear runs of the bands normally engaging each other and being separable to receive film laminae therebetween, the linear runs of the bands also having flat outer sides, means mounting said bands on the frame for movement along said runs, heating means on the frame and extending along said linear runs of the transfer bands and supplying sealing heat to and through the bands to the film laminae between said runs, said heater means including non-rotating heat transfer elements with flat surfaces continuously bearing inwardly and sliding against the flat outer sides of said linear runs of both of the heat transfer bands, said heating means including mountings for said heat transfer elements and permitting movement of said elements in a direction toward and away from the linear runs of said bands, said mountings comprising elongate heater bars stationary on the frame and extending along such linear runs, means producing heating of such heater bars, said heater bars having elongate slots extending along such runs and confronting the flat outer sides of the bands, the slot in each heater bar carrying a plurality of said heat transfer elements in free sliding engagement with the heater bar and accommodating movement of the heat transfer elements under influence of the springs and of the endless bands, and spring means urging said heat transfer elements toward the linear runs of said heat transfer bands, said spring means being yieldable under influence of film laminae passing between the bands which bear outwardly against the heat transfer elements and allow separation of the bands to allow the film laminae being sealed to pass along the linear runs while continuously maintaining spring pressure against the film laminae during the heating and sealing.

11. The invention according to claim 10 and such spring means including a plurality of slide rods projecting throug bearing apertures in the heater bars and extending toward the flat outer sides of the bands in such linear runs, said rods being spring pressed toward and bearing against and urging the heat transfer elements toward said linear runs.

* * * * *